United States Patent [19]

Ho

[11] Patent Number: 4,662,458

[45] Date of Patent: May 5, 1987

[54] METHOD AND APPARATUS FOR BOTTOM HOLE MEASUREMENT

[75] Inventor: Hwa-shan Ho, Spring, Tex.

[73] Assignee: NL Industries, Inc., New York, N.Y.

[21] Appl. No.: 790,342

[22] Filed: Oct. 23, 1985

[51] Int. Cl.[4] ..... E21B 7/08; E21B 47/12

[52] U.S. Cl. ..... 175/27; 175/45; 175/61

[58] Field of Search ..... 175/27, 40, 45, 61; 73/151

[56] References Cited

U.S. PATENT DOCUMENTS

| | | | |
|---|---|---|---|
| 4,303,994 | 12/1981 | Tanguy | 175/45 |
| 4,324,297 | 4/1982 | Denison | 175/61 |
| 4,445,578 | 5/1984 | Millheim | 175/61 |
| 4,479,564 | 10/1984 | Tanguy | 175/45 |

OTHER PUBLICATIONS

"Three-Dimensional Bottomhole Assembly Model Improves Directional Drilling", by P. N. Jogi, T. M. Burgess and J. P. Bowling, IADC/SPE 14768, 1986 IADC/SPE 1986 Drilling Conference.

*Primary Examiner*—James A. Leppink
*Assistant Examiner*—Terry Lee Melius
*Attorney, Agent, or Firm*—Browning, Bushman, Zamecki & Anderson

[57] ABSTRACT

A method and apparatus for obtaining complete loading on a drill bit at the end of a drill string in a borehole employ at least three rosette strain gauges uniformly disposed on an instrument sub to measure torque and axial force on the sub, two bending moments in mutually perpendicular directions, and two shear forces in mutually perpendicular directions. These measurements are used to obtain torque on bit, weight on bit, two side forces on the bit normal to each other, and two bending moments on the bit normal to each other which, in turn, can be used to control the bit movement.

14 Claims, 6 Drawing Figures

METHOD AND APPARATUS FOR BOTTOM HOLE MEASUREMENT

BACKGROUND OF THE INVENTION

1. Field of the Invention

The present invention relates to a method and apparatus for providing a more realistic and flexible interpretation of measurement-while-drilling data in order to better predict the direction of advance of the drill and provide better evaluation of the mechanical properties of the formations encountered.

2. Description of the Background

It is well known in the petroleum industry that it is substantially impossible to drill a hole straight down through the earth without any deviation from an axially vertical position. Indeed, it may often be preferable to be able to control the direction of the drill so as to enable a plurality of wells to be drilled from a single platform, such as is the case for offshore drilling. It may also be desirable to control the direction of the drill so as to enter a particular strata formation with a specific orientation.

There are two accepted techniques for measuring the inclination of a drill bit so as to guide it toward the desired direction. The first requires the cessation of drilling while instruments are lowered on a wire line into the borehole to determine the inclination and compass heading of the borehole. Successive readings allow a determination of the rate of build or drop or rate of turn and thereby estimate the appropriate action to counter any undesired drift and return the direction of the bit toward the desired optimum conditions. However, this is a slow process requiring the interruption of the drilling operation.

A preferred method is a more recent development which is termed "measuring-while-drilling" in which measurements are made continuously without interrupting the drilling operation. Of course, it is necessary to get the data measured to the surface. There are at least two accepted means for doing this. One transmits the data to the surface using pressure pulses produced in a drilling fluid or mud stream while the other is a hard wired system wherein the data can be transmitted over an electrical circuit to the surface. The first system, while being relatively simple, is limited to low data rates and only a minimum amount of information can be transmitted. The second system, while more difficult to develop, provides a fast data rate which is capable of transmitting a considerable amount of information substantially instantaneously to the surface. Both systems include a means to measure the inclination and orientation of the borehole and transmit that data to the surface.

In current practice, only certain components of the force resultants are measured downhole using such measurement-while-drilling tools. U.S. Pat. No. 4,324,297 measures two bending moments, which are used to infer side forces at the bit. U.S. Pat. No. 4,445,578 measures two shear forces, and these are then used to infer the side forces at the bit. Consideration of fundamental laws of equilibrium shows that, when bending moments exist at the bit, these measurements made by the prior art are insufficient for determining the total loading state at the bit, and therefore they are insufficient to predict drilling direction tendencies, particularly when there are intervening contacts between the bottom hole assembly and the borehole.

SUMMARY OF THE INVENTION

The present invention constitutes an improvement over the prior art in that the prior art has always assumed that the bit is free of bending moments. The present invention is based on the recognition that there are bending moments at the bit and therefore sensing devices are provided to measure the weight-on-bit, the torque of the bit, two shear forces normal to each other and two bending moments normal to each other. The present invention is thus capable of producing a complete set of downhole force-moment measurements which can be resolved by calculations to produce the complete loading at the bit. These calculations can then be used, through bottom hole assembly deformation analysis, to effectively detect any abnormal deviation tendency, detect formation interface and lithology change, predict advance directions for the bit, and instantaneously adjust operating conditions to control the drilling direction.

BRIEF DESCRIPTION OF THE DRAWINGS

The present invention will be described by way of example with reference to the accompanying drawings in which.

DETAILED DESCRIPTION OF THE PREFERRED EMBODIMENT

Figures 1, 3A, 3B:
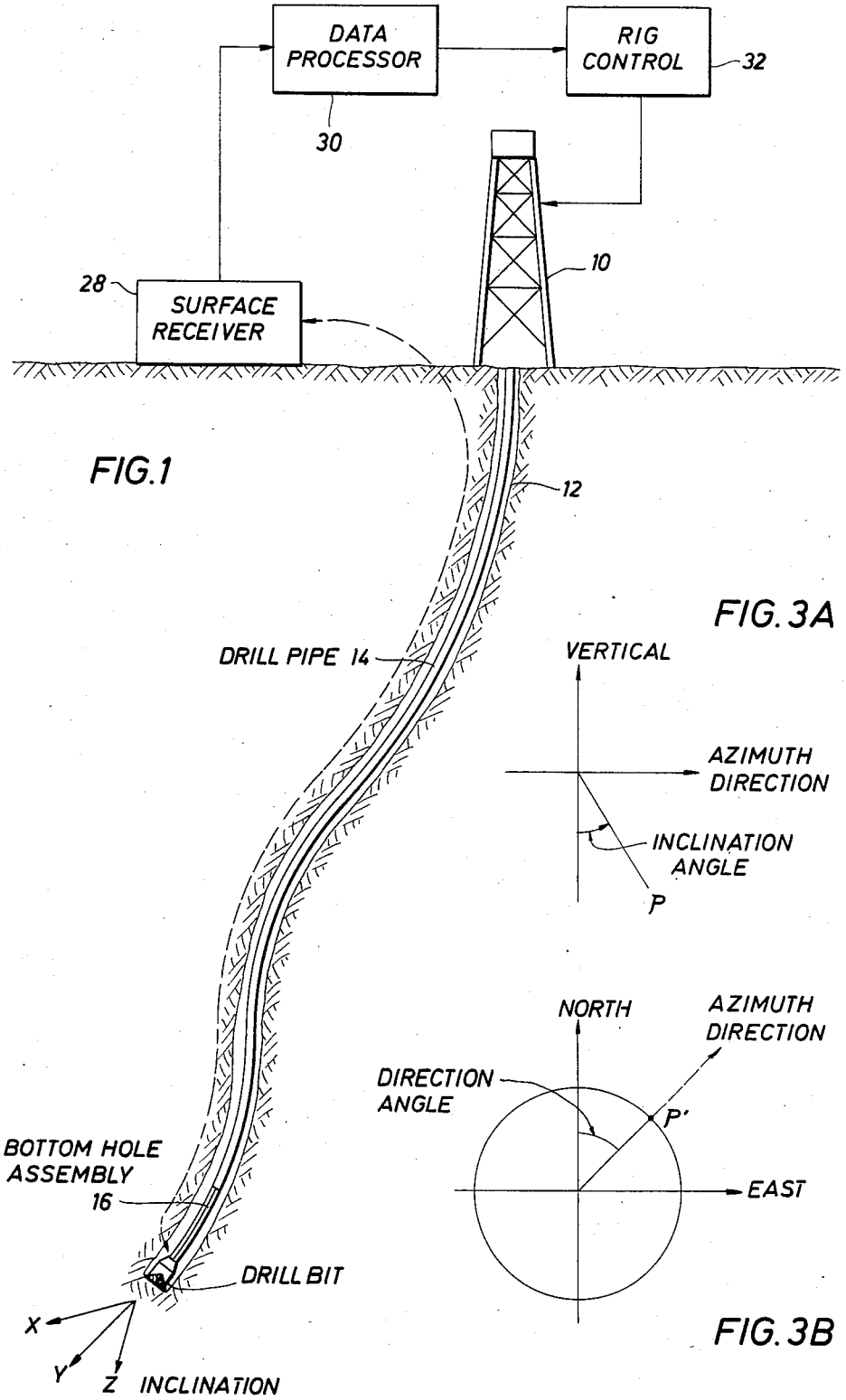
FIG. 1 is a diagrammatic representation of a well being drilled and controlled in accordance with the teachings of the present invention.
FIGS. 3*a* and 3*b* are diagrams of the components at the bottom of the borehole.
Figures 2, 4:
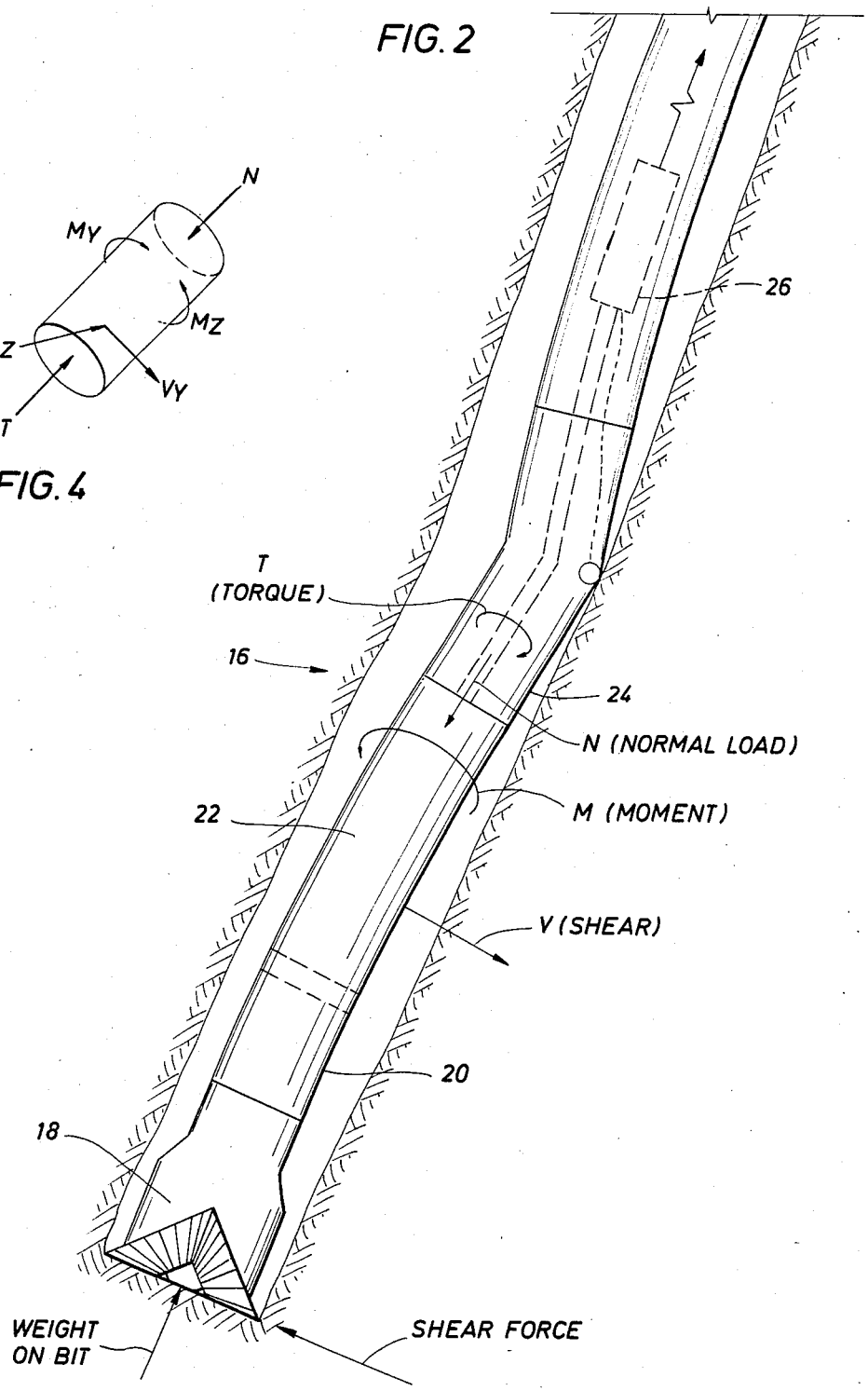
FIG. 2 is a diagrammatic representation of one type of downhole assembly incorporating the teachings of the present invention.
FIG. 4 is a diagrammatic view of an equipment sub of a bottom hole assembly showing measurements made in accordance with the present invention.

The diagrammatic representation of FIG. 1 shows a land-based drilling rig 10 used for drilling a borehole 12 and from which rig a drill string 14 is suspended with a bottom hole assembly 16 at the lower end. The present invention is equally adaptable to offshore drilling and is not restricted to a land-based configuration, which is used for illustration purposes only. The actual drilling can be accomplished by either of two known methods of drilling, namely driving the drill pipe 14 from the surface or having the bottom hole assembly 16 provided with a motor means to drive the drill bit. In the present example, the downhole assembly 16 is shown including a bit 18, motor means 20 to drive the bit, an instrumentation sub 22, an orienting sub or stabilizer 24, and a transmitter 26. The transmitter 26 is shown hard wire connected to a surface receiver 28 which, in turn, is connected to a data processing unit 30 and a rig control system 32. The data can, alternatively, be transmitted through the fluid column or through other means (not shown). The borehole has three components, X, Y and Z. X is the direction, Y the inclination and Z the axis of the borehole. The forces and moments are measured on the bottom hole assembly 16 and bit 18 by an array of strain gauges shown diagrammatically in FIG. 4 by the measurements they make. These measurements are transmitted to the receiver 28 at the surface and then to data processor 30. The measurements will show the side forces and moments and, by knowing the components, the amount the bit will cut sideways in the next length of borehole drilled can be determined. The actual measurement of the forces can show many things to a driller. For example, a high side force on the bit could indicate high curvature in the hole, the possibility of a transition zone or the start of a dogleg situation, all of which would require corrective action.

Figure 5:
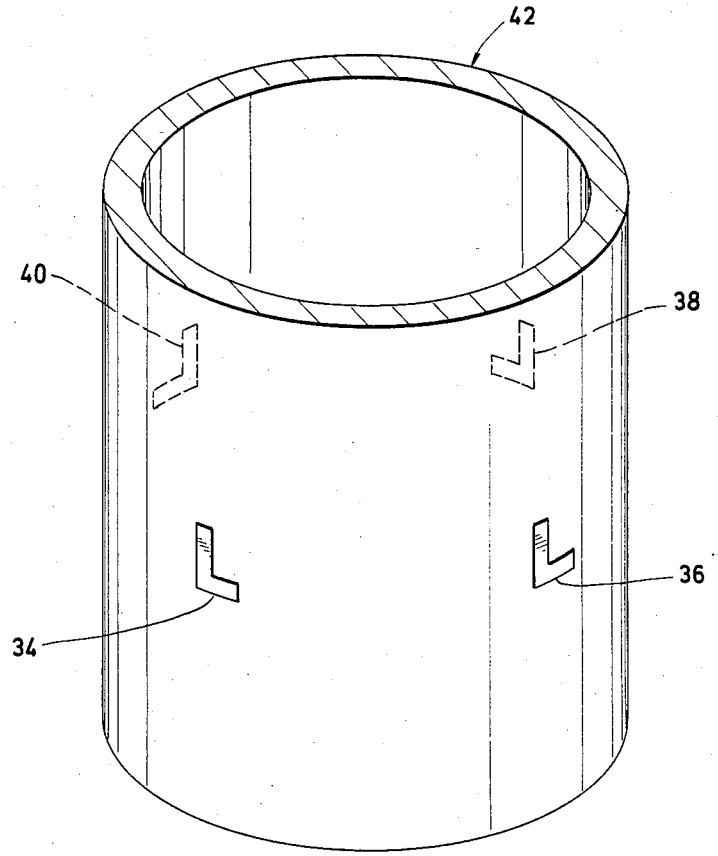
FIG. 5 is a diagrammatic perspective view of a portion of an equipment sub showing four strain gauges spaced about the circumference thereof.

The present invention is distinguished from the prior art devices by having sufficient measurement gauges in order to deduce, by standard engineering mechanics, all force and moment components, namely the axial force N, the torque T, two shear force components $V_1$, $V_2$ normal to each other, and two bending moment components $M_y$, $M_z$ normal to each other. The gauges are only shown diagrammatically in FIG. 4 as to what they are measuring. These preferably would be at least three 90° or 45° rosette strain gauges uniformly spaced about the circumference of the sub. FIG. 5 shows four 90° rosette strain gauges 34, 36, 38, 40 on a sub 42. This complete load set measurement is made spaced from the bit but will enable determination of the bit moments and the force components by standard structural mechanics. Thus, in accordance with the present invention, the measurements can be made in an instrument sub adjacent the bit, as shown, or at a point above an orienting sub or stabilizer 24.

The purpose of making these measurements is to enable computation of the bit side forces and bit bending moments while drilling. This cannot be done by simple bending moment measurements or simpler shear force measurements alone, as taught by the prior art. Bit bending moments are particularly significant when drilling into changing lithology or when building or dropping the borehole direction during directional drilling. Knowing the bit side forces is important in predicting the bit advance direction during directional drilling. In a measuring-while-drilling environment, successive comparisons of the measured side forces to the calculated side forces will provide the driller with a great deal of information about the formation being drilled.

The present invention provides a complete set of downhole force-moment measurements. By using standard structural mechanics, these measurements are resolved to loading at the bit. Through bottom hole assembly deformation analysis, using the above data and a rock bit interaction model, the following can be accomplished: detection of any abnormal deviation tendency; detection of formation dip/interface and lithology change; prediction of bit advance direction; and instantaneously adjust operating conditions to control drilling direction.

The present invention can be used in combination with known means (not shown) to measure borehole orientation (both inclination and azimuth or compass heading) to control the direction of drilling by appropriately changing bit loading.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. An apparatus for use in determining drilling conditions in a borehole in the earth comprising:

a drill string depending into a borehole;

a drill bit connected to the lower end of said drill string;

an instrument sub connected between the drill bit and drill string;

measurement means in said instrument sub to measure circumferential shear strain and axial strain at at least three circumferentially spaced locations on said instrument sub; and means to process the measurements to obtain three force and three moment components on said instrument sub.

2. An apparatus according to claim 1 wherein said measurement means are strain gauges.

3. An apparatus according to claim 1 wherein said measurement means comprises at least three rosette strain gauges.

4. An apparatus according to claim 1 further comprising means to transmit measurements from said measurement means to the surface.

5. An apparatus according to claim 1 further comprising means to control the bit in response to measurements of said measurement means.

6. An apparatus according to claim 1 wherein said measurement means are strain gauges uniformly disposed about the circumference of said instrument sub.

7. An apparatus according to claim 1 wherein said measurement means comprise three two-leg 90° rosette strain gauges disposed on said instrument sub space 120° apart.

8. An apparatus according to claim 1 wherein said measurement means comprise four two-leg 90° rosette strain gauges disposed on said instrument sub spaced 90° apart.

9. An apparatus according to claim 1 wherein said measurement means measure:

torque on said instrument sub;

two bending moments in two mutually perpendicular directions;

axial force on said instrument sub; and two shear forces on said sub in two mutually perpendicular directions.

10. An apparatus according to claim 9 further comprising means to use said measurements to obtain complete loading on the bit, including:

torque on bit;

weight on bit;

two side forces on the bit in two directions normal to each other; and two bending moments on the bit in two directions normal to each other.

11. An apparatus according to claim 10 wherein said means to use said measurements incorporates structural mechanics to quantitatively infer said three force and three moment components at said drill bit whereby drill string components, such as stabilizers and orienting subs between said drill bit and said instrument sub do not invalidate bit loading computations.

12. A method of measuring and controlling drilling of a borehole in the earth by a drill string having a bottom hole drilling assembly including an instrument sub and drill bit connected at the lower end of the drill string, said method comprising the steps of:

measuring shear strain and axial strain at at least three circumferentially spaced locations on said instrument sub to obtain complete measurements to enable two shear forces and an axial force and two bending moments and one torsional moment resultant computations; and processing said computed forces and moments to obtain weight-on-bit, torque-on-bit, two bending moments and two bit side forces representing the total loading on the bit.

13. A method according to claim 12 wherein said processing of said computed forces and moments is by engineering mechanics.

14. A method according to claim 12 wherein said loading on the bit is obtained from said computed forces and moments by structural mechanics taking into consideration drill string components between a drill bit and the point of measurement.

* * * * *